United States Patent [19]

Lacy

[11] 4,087,875

[45] May 9, 1978

[54] APPARATUS FOR FORMING AND THREADING STOCK

[76] Inventor: Dean Lacy, 40375 Grand River, Novi, Mich. 48050

[21] Appl. No.: 758,308

[22] Filed: Jan. 10, 1977

[51] Int. Cl.[2] ..... B21K 1/44; B23G 11/00

[52] U.S. Cl. ..... 10/11 R; 10/27 UB; 10/105

[58] Field of Search ..... 10/11 R, 27 UB, 89 F, 10/89 R, 105, 139 R; 408/129

[56] References Cited

U.S. PATENT DOCUMENTS

| | | | |
|---|---|---|---|
| 1,796,538 | 3/1931 | Rupple | 10/105 |
| 2,376,164 | 5/1945 | Miller et al. | 10/105 |
| 2,923,015 | 2/1960 | Pethybridge et al. | 10/89 R |
| 3,518,902 | 7/1970 | Matson | 10/139 R |

FOREIGN PATENT DOCUMENTS

| | | | |
|---|---|---|---|
| 1,594,105 | 7/1970 | France | 10/11 R |

*Primary Examiner*—E. M. Combs

*Attorney, Agent, or Firm*—Harness, Dickey & Pierce

[57] ABSTRACT

There is disclosed herein an apparatus adpated for use on a conventional four slide machine which allows one or more end portions of a length of stock to be threaded simultaneously with the forming of another portion of the stock to a desired contour. The apparatus includes a thread rolling head driven by a motor, both of which are secured to a compound slide which is mounted on a four slide machine and adapted to be reciprocated through the agency of a cam and cam follower arrangement provided on the four slide machine. This apparatus allows stock of any cross-sectional shape suitable for the formation of threads thereon to be fed into the four slide machine, an appropriate length severed therefrom and the end portions threaded while additional portions thereof are formed into any of a variety of irregular contours, all in a single opration, thereby eliminating the need for manually transferring the workpiece between separate machines or providing progressive work stations and associated workpiece transfer means, should such automated equipment be available.

13 Claims, 3 Drawing Figures

FIG. 2.
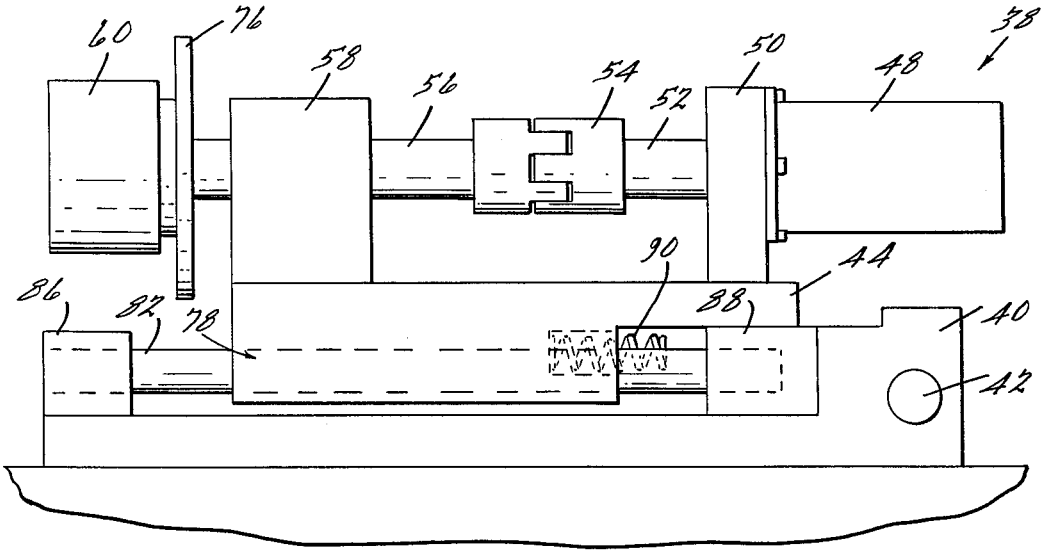
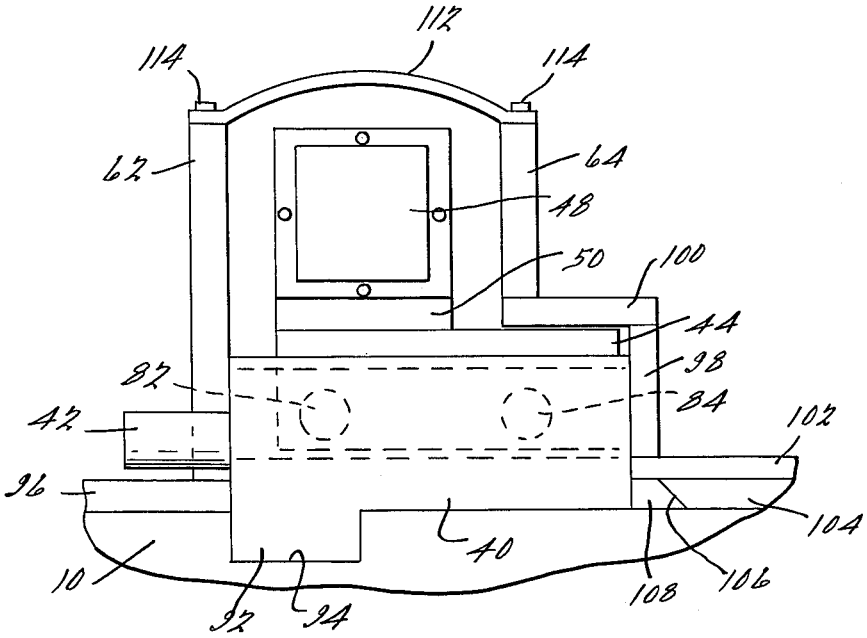
FIG. 3.

APPARATUS FOR FORMING AND THREADING STOCK

BACKGROUND AND SUMMARY OF THE INVENTION

This invention relates generally to threading and forming methods and apparatus for accomplishing these tasks and, more specifically, to such threading and forming apparatus which enables one to simultaneously form and thread a piece of stock at a single work station of a four slide machine.

A great variety of manufactured products require various lengths of rod or the like to be formed to an irregular contour and have one or more ends thereof provided with threads, such as for the attachment of the rod member to some other part of mechanism. Such items are particularly common on automotive vehicles, finding applications in the form of interconnecting linkages such as throttle controls and shifting linkages, or as fastening devices such as spare tire or battery hold-downs. Even some common hardware items such as "U" bolts or other types of anchor bolts are generally within this category, all of which generally require threads to be provided on at least one end thereof.

In one method of manufacturing such items utilized by many small job shops, suitable stock is first cut to the desired length by any suitable means such as on a shear or the like. Next, the workpieces are transferred to a threading machine either manually or by automated machinery, where the threads are formed thereon normally by means of a conventional die which cuts the threads into the workpiece. Generally, the machines employed in the threading operation are not adapted to handle workpieces which are not straight, thus requiring the threading operation be performed prior to any shaping of the workpiece. Thereafter, the threaded workpieces are transported to a four slide machine or other forming machine for shaping into the desired finished contour. As the threads are already formed on the workpiece, care must be taken in the design of the forming tooling to avoid damage thereto. Often these products, such as various types of linkages and the like used in the production of automobiles, are fabricated by relatively small job shops which may not have both threading and forming machinery, thus requiring the parts be transported between separate manufacturing facilities. Even should all the machinery be available at the one location, automated feed equipment between this machinery will most likely not be available due to the limited production runs generally encountered and the substantial investment required. Thus, the workpieces must be manually transported from one machine to the next. Even assuming a fully automated operation, the necessity of performing these operations sequentially substantially increases the time required to transform raw stock into the finish products and, thus, also increases the cost of such products. These time and cost factors are significantly magnified when the product is a high volume item such as generally encountered in production of parts for the automotive industry as well as such common hardware items as eye bolts, "U" bolts, anchor bolts and the like.

Accordingly, the present invention provides a method and apparatus by which a four slide machine may be adapted to simultaneously form and thread a workpiece thus allowing substantial reductions in production time and associated costs as well as minimizing material handling requirements. The apparatus includes a thread rolling head and motor for driving the same, both of which are mounted on a compound slide which is, in turn, movably secured to the four slide machine. The lower slide member is provided with a cam follower which engages a cam on the four slide machine to reciprocate the threading apparatus into and out of engagement with the workpiece. An upper slide member allows the threading apparatus to move longitudinally with respect to the lower slide member. In operation, a continuous length of stock is automatically fed into the four slide machine and a predetermined length is severed therefrom. A first forming tool means is advanced to clamp the workpiece just prior to its being severed from the supply stock. Thereafter, other forming tooling is advanced to engage and shape a portion of the workpiece simultaneously with the advancement and operation of the threading apparatus. The operational sequencing of both the threading apparatus and forming tooling is controlled by a plurality of cams conventionally provided on four slide machines. Upon completion of the threading and forming operations, all of the tooling is retracted and the completed product is ejected or otherwise removed from the machine thus completing the operational cycle.

The finished product is not only produced more quickly and at lower cost but additionally is superior in that the present invention rolls the threads on the product as opposed to conventional operations which generally cut the threads. Rolled threads necessarily have superior strength characteristics due to the hardening effect created by cold working the metal. Further, the present invention allows a small machine shop specializing in forming operations which may not have threading machinery to readily adapt an existing four slide machine to perform threading operations with a relatively small capital investment as compared with the purchase of separate automated threading apparatus.

Other features and advantages of the present invention will become apparent from the subsequent description and the appended claims taken in conjunction with the accompanying drawings.

BRIEF DESCRIPTION OF THE DRAWINGS

FIG. 2 is a side view of the threading apparatus of the present invention including the compound slide; and FIG. 3 is an end view of the threading apparatus in operative relationship to a portion of the four slide machine.

DETAILED DESCRIPTION OF THE PREFERRED EMBODIMENT

Figure 1:
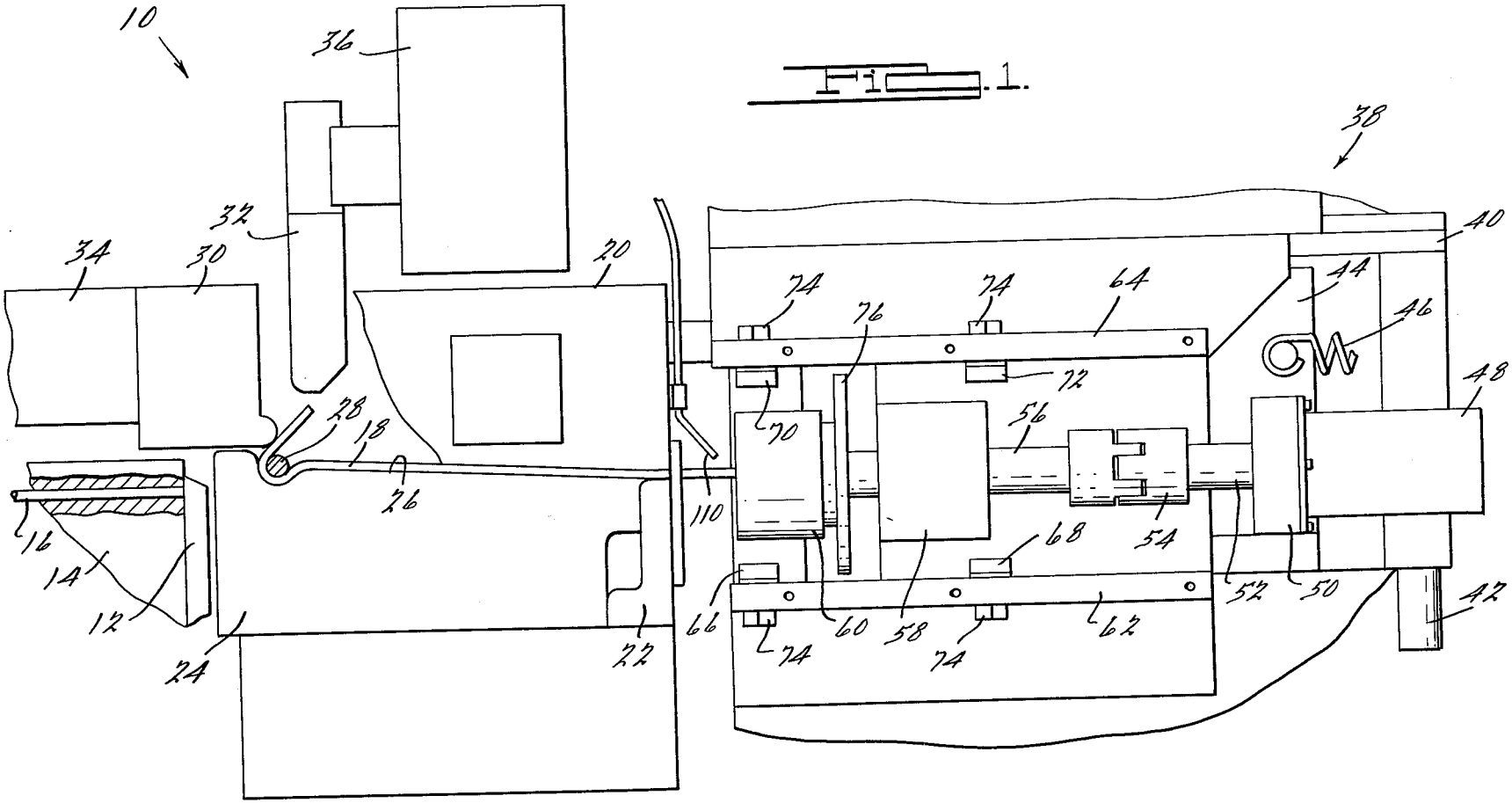
FIG. 1 is a top view of a portion of a conventional four slide machine having threading apparatus in accordance with the present invention installed thereon and a workpiece being simultaneously formed and threaded.

Referring now to FIG. 1, there is shown therein a portion of a conventional four slide machine generally indicated at 10. Four slide machine 10 has a cutting tool 12 which reciprocates through the cooperation of a cam and cam follower adjacent a stationary member 14 through which stock 16 is fed into the working area of the machine 10. A feed mechanism (not shown) is provided which advances a length of stock forward into the work station, at which time cutting tool 12 will be moved inward thereby severing a workpiece 18 of any predetermined length from the stock 16.

Four slide machine 10 has a centrally located stationary portion 20 and a first tool member 22 which is advanced slightly ahead of cutting tool 12 so as to clamp workpiece 18 between first tool member 22 and stationary portion 20 thereby positioning and supporting workpiece 18 as it is severed from stock 16. Immediately thereafter, a second tool member 24 is caused to advance and engage workpiece 18 and perform a first forming operation thereon causing workpiece 18 to conform to the contour of face portion 26 of tool member 24.

For purposes of illustration and description herein, the four slide machine 10 is set up for the fabrication of an automotive battery hold-down rod having a loop formed in one end and threads provided on an opposite end thereof. As illustrated in FIG. 1, the advancement of tool member 24 will cause workpiece 18 to be shaped about a stationary mandrel 28 mounted on the four slide machine thus partially forming a loop at one end of workpiece 18. Thereafter, second and third tooling members 30 and 32 respectively, each of which is mounted on sliding tool holding members 34 and 36 respectively, are brought into engagement with workpiece 18 thereby completing the formation of the loop about mandrel 28. Sliding tool holding members 34 and 36 have cam followers provided on a portion thereof which engage cams provided on and driven by the four slide machine. The arrangement of these cams and cam followers control the timing of the sequential forming operation and may be altered to any desired configuration for sequential, simultaneous or multiple actuation. The above described forming operation is typical of those operations which are performed on a four slide machine, all of which are well known in the art. Thus, further more detailed description thereof is believed unnecessary.

The threading apparatus of the present invention is illustrated in FIG. 1 in operative relationship to the four slide machine 10 and indicated generally at 38. Threading apparatus 38 comprises a lower slide member 40 which is adapted to travel longitudinally in machined ways provided on the four slide machine 10. Slide member 40 has a cam follower 42 protruding laterally from the rear portion thereof which is adapted to engage a cam (not shown) on four slide machine 10 which is adapted to longitudinally reciprocating slide member 40. A second slide member 44 is mounted on lower slide member 40 in such a manner as to allow independent longitudinal travel thereof with respect to lower slide 40. One end of a helical coil spring 46 is secured to a portion of upper slide member 44 so as to bias slide member 44 rearward with respect to lower slide member 40. The other end of helical coil spring 46 is secured to any convenient stationary member, or alternatively may be secured to lower slide member 40. Also, while a spring is illustrated herein, any other suitable means capable of biasing upper slide member 44 rearwardly with respect to lower slide member 40 may be substituted therefor. A motor 48 is secured to an upward projecting support member 50 which is, in turn, secured to upper slide member 44. Hydraulic motors are particularly well suited for this operation as they are capable of relatively high torque output, produce a low operational noise level and require minimal maintenance. However, any other driving means may be substituted therefor such as an electric of pneumatic motor for example. Motor 48 has a shaft 52 which extends forward through support member 50 to a coupling member 54 which joins shaft 52 to one end of a second shaft 56. Support member 50 will generally be provided with a bearing to support shaft 52 and allow reduced friction rotation thereof, as well as to prevent both radial and axial stresses from being transmitted to motor 48. Shaft 56 extends through a forward bearing support member 58 which may also be provided with a thrust bearing and has a thread rolling head 60 secured to its forward end. Bearing support member 58 is secured to the forward portion of upper slide member 44, thereby allowing thread rolling head 60, motor 48 and interconnecting shafts 52 and 56 to move longitudinally with respect to lower slide member 40. Extending longitudinally along opposite sides of slide members 40 and 44 are a pair of stationary guide members 62 and 64 which are secured to four slide machine 10. Guide members 62 and 64 each have a longitudinally extending elongated slot provided therein through which roller stops 66, 68, 70 and 72 are adjustably secured through the agency of bolts 74 or other similar fastening devices. Roller stops 66 and 70 are aligned opposite each other so as to simultaneously engage an annular flange 76 provided on thread rolling head 60 at its forward most point of travel. Flange 76 is adapted to move axially a small distance with respect to thread rolling head 60 thereby causing a plurality of thread rollers disposed interiorly of thread rolling head 60 to move radially so as to engage or release a workpiece centrally disposed within head 60 upon respective forward or rearward movement of flange 76, such as is caused by the engagement thereof with roller stops 66, and 70. Similarly, roller stops 68 and 72 are positioned opposite each other on respective guide members 62 and 64 so as to engage flange 76 at the rearward limit of its travel thereby causing flange 76 to move forward with respect to thread rolling head 60 which, in turn, will cause the thread rollers to move radially inward in preparation for threading a subsequent workpiece. More detailed description of the specific operation of thread rolling head 60 and associated flange 76 is not believed necessary as such items are commercially available.

The operative relationship of slide members 40 and 44 and four slide machine 10 is best seen with reference to FIGS. 2 and 3 in which similar elements are identified by the same numerals as utilized with reference to FIG. 1. Upper slide member 44 is generally rectangular in shape and of a generous thickness so as to provide a stable platform upon which to mount the thread rolling head 60, motor 48 and supports 58 and 50. Slide member 44 has a pair of longitudinally extending, spacing apart bores 78 extending through a lower portion thereof which are adapted to receive travel members 82 and 84 respectively. Travel members 82 and 84 may be of any desired cross-sectional shape and generally will be fabricated from hardened steel so as to prevent excessive wear. Bores 78 will be of a similar cross-sectional shape and of a size so as to provide a close fit to travel members 82 and 84, yet allow free travel of upper slide 44 therealong. Bushings may be provided within bores 78 if desired so as to provide a replaceable bearing surface between the walls of bores 78 and travel members 82 and 84, as it is important that lateral shifting of upper slide member 44, with respect to lower slide member 40, be prevented. Travel members 82 and 84 each have a forward end secured in a support member 86 which is, in turn, secured to lower slide member 40 in any suitable manner such as through the agency of a plurality of bolts. Similarly, the rear end of each travel member is secured to a support member 88 which is also similarly secured to lower slide member 40. As is readily apparent, upper slide member 44 is mounted on lower slide member 40 in such a manner as to be freely movable in a longitudinal direction along travel members 82 and 84 and between support members 86 and 88. A small spring member 90 is disposed within a shallow bore 92 provided in upper slide 44 and laterally positioned between travel members 82 and 84 so as to extend rearwardly from slide member 44 so as to thereby cushion the impact between upper slide 44 and support 88 when upper slide is moved backward in response to the biasing force exerted by spring 46, previously described. While a spring is illustrated for this purpose, any other suitable shock absorbing means may be easily substituted therefor, which will prevent upper slide 44 from rebounding off support 88.

As best seen in FIG. 3, lower slide member 40 has a lower extending portion 92 adapted to fit within a machined way or slot guide 94 provided on the four slide machine 10. Slot guide 94 serves to prevent lateral movement of lower slide member 40, as well as to guide its longitudinal movement and insure the thread rolling head will be accurately positioned with respect to the workpiece.

Stationary guide member 62 is secured to a base plate 96 which, in turn, is also secured to four slide machine 10 through the agency of suitable fasteners and serves as an additional guide member to prevent lateral movement of lower slide member 40. Stationary guide member 64 is also secured to four slide machine 10 in a similar manner but includes one vertical and two horizontal members 98, 100 and 102 respectively between base plate 104 and stationary guide member 64. Additionally, base plate 104 has an angled edge 106 adjacent lower slide 40 adapted to engage a longitudinally extending gib member 108 secured to one side of lower slide member 40, thereby providing means to further insure against any lateral shifting of lower slide member 40 as it is caused to longitudinally reciprocate.

Additionally, it may be desirable to provide means for spraying a lubricant on the workpiece adjacent the thread rolling head in order to both cool and lubricate the thread rollers. Such provisions may be easily incorporated by merely providing a small nozzle 110 adjacent the workpiece, as illustrated in FIG. 1. However, as the thread rolling head is being continuously rotated at a relatively high speed, the lubricant will be thrown off by the centrifugal force. It is thus desirable to provide a shield over the thread rolling head to prevent excessive splashing of this lubricant. This may be easily accomplished, as illustrated in FIG. 3, by forming a generally rectangular shaped portion of transparent plastic 112 or other like material into a generally arcuate shape and securing it to the top portion of stationary guides 62 and 64 by a plurality of bolts 114. Shield 112 will not only prevent lubricant from being thrown out of the work area but, as it is transparent, will allow the operator to continuously monitor the threading operation.

As previously mentioned, a machine cycle is initiated with cutter 12, tool members 22, 24, 30 and 32, and upper and lower slide members 40 and 44 in a fully retracted position, at which point a feed mechanism will advance a portion of stock 16 a predetermined distance into the work area of the four slide machine 10. Once the stock 16 has been fully advanced into the work area, tool member 22 will be advanced to clamp the forward portion of the stock against stationary member 20 while cutter 12 severs the workpiece 18 from the stock 16. Thereafter, tool members 24, 30 and 32 will sequentially be advanced to form workpiece 18 into the desired configuration. Immediately after cutter 12 has severed workpiece 18 from stock 16, and simultaneously with the actuation of tool members 24, 30 and 32, a suitably designed cam engaging cam follower 42 will cause lower slide 40 to move forward thus causing upper slide 44 and thread rolling head 60 to move forward into engagement with an end portion of workpiece 18. Motor 18 will be continuously rotating thread rolling head 60 so that upon engagment thereof with workpiece 18, thread rolling head 60 will begin rolling threads thereon. Lower slide 40 is advanced only far enough toward workpiece 18 by the cooperation of cam and cam follower 42 to insure thread rolling head 60 will roll an initial two or three threads on workpiece 18. Thereafter, these initial threads will cause thread rolling head 60 to be drawn further along workpiece 18 forming additional threads thereon and causing upper slide 44 to move forward with respect to lower slide 40 along travel members 82 and 84. Lower slide member 40 will be held in a stationary position during this operation. Once thread rolling head 60 has threaded a desired portion of workpiece 18, flange 76 will engage roller stops 66 and 70 causing it to cease its forward travel while head 60 moves a slight distance further forward. This action will cause the thread rollers within head 60 to move radially outward, thus releasing workpiece 18. Upper slide member 44 will then be caused to moved rearwardly with respect to lower slide 40 through the biasing action of spring 46. Thereafter, cam follower 42 will move both upper and lower slide members 40 and 44 to their fully withdrawn position at which point flange 76 will engage roller stops 68 and 72 thereby causing the thread rollers within head 60 to move radially inwardly in preparation for the next cycle. In like manner, and simultaneously with the withdrawal of lower slide 44, tool members 22, 24, 30 and 32 are withdrawn, the completed part is ejected from the machine and four slide machine 10 is ready for a new cycle.

In an actual prototype operation of the present invention, a Nilson Number 4 Four Slide Machine was fitted with the threading apparatus, as described above, for the fabrication of automotive battery hold-down rods. The thread rolling head was driven by a DM-4 hydraulic motor available from Delta Power Hydraulic Company. Previous experimentation had employed a pneumatic motor successfully, however the hydraulic motor was found to be better suited as it was quieter in operation and had superior torque capabilities thus avoiding the possibility that the thread rolling head might stall should a substantially harder surface portion be encountered in the workpiece. It was discovered through actual operation that approximately three times as many of such parts could be produced within a given time period. Thus, the time and cost savings of the present invention over previous methods is readily apparent. Also, as the present invention is substantially automatic and performed on a single machine, only one operator is required as opposed to other methods in which several operators may be required or, at least, an operator having the capability of operating a variety of machines. Further, no additional labor or machinery will be required to transport parts between successive machines. Thus, the method and apparatus disclosed herein offers substantially increased productivity, reduces the capital investment in machinery required for manufacturing such products, reduces labor costs and even produces a product having superior thread strength. Also, as the apparatus herein described may be easily and quickly removed from the four slide machine, the flexibility of the four slide for adaption to the fabrication of other parts is in no way impaired.

It should also be noted that while the present invention has been described in detail with reference to a workpiece requiring only one end be provided with threads, a second thread rolling apparatus assembly may be similarly incorporated into the four slide machine in like manner to simultaneously thread another end portion. In the fabrication of some products, it may not be possible to simultaneously form and thread the workpiece but rather, require these steps be performed sequentially. However, the versatility of the cam actuation means provided on the four slide machine allows the operational timing sequence to be easily changed. Even should sequential operations be necessitated, the method and apparatus disclosed herein will still provide substantial labor, time and capital investment saving advantages in that all operations are performed at a single work station on a single machine.

While it is thus apparent that the method and apparatus of the present invention as disclosed herein offers substantial advantages, it will be appreciated that the invention is susceptible to modification, variation and change without departing from the proper scope or fair meaning of the subjoined claims.

I claim:

1. Apparatus adapted for use with a four slide machine for enabling said four slide machine to thread at least one end portion of a workpiece while another portion of said workpiece is being shaped, said apparatus comprising:

a thread rolling head;

driving means connected to said thread rolling head and adapted to continuously rotate said thread rolling head;

means for reciprocating said thread rolling head and said driving means with respect to said four slide machine so as to cause said thread rolling head to engage an end portion of said workpiece, said reciprocating means being movably secured to said four slide machine;

a first sliding member movably supported upon said reciprocating means, said driving means and said thread rolling head being fixedly secured to said sliding member and movable in a direction parallel to the direction of movement of said reciprocating means so as to allow movement of said thread rolling head subsequent to engagement with said workpiece while said reciprocating means remains stationary;

first stop means adapted to close said thread rolling head upon its withdrawal from said workpiece;

second stop means adapted to open said thread rolling head once said workpiece has been threaded; and means securing said first and second stop means to said four slide machine.

2. Apparatus as set forth in claim 1 wherein said reciprocating means includes:

a second sliding member movably secured to said four slide machine so as to impart reciprocal longitudinal movement to said first sliding member.

3. Apparatus adapted for use in a four slide machine as set forth in claim 2 wherein said first sliding member is secured to said second sliding member through the cooperation of a pair of spaced apart substantially parallel bores extending longitudinally through said first sliding member, a pair of travel members extending through said bores, and means securing said travel members to said second sliding member in such a manner as to allow said first sliding member to be movable along said travel members.

4. Apparatus adapted for use in a four slide machine as set forth in claim 3 wherein said securing means comprises a first member securing one end of each of said travel members to said second sliding member, and a second member securing another end of each of said travel members to said second sliding member, said first and second members being further adapted to limit the travel of said first sliding member therebetween.

5. Apparatus adapted for use in a four slide machine as set forth in claim 4 further comprising means biasing said first sliding member into engagement with one of said first and second securing members and away from said workpiece.

6. Apparatus adapted for use in a four slide machine as set forth in claim 1 wherein said driving means comprises a motor and a drive shaft connecting said motor to said thread rolling head, and further comprising a bearing support member for rotatably securing said shaft to said first sliding member, said bearing support member including both anti-friction and thrust bearing means.

7. Apparatus adapted for use in a four slide machine as set forth in claim 1 wherein said thread rolling head includes an annular flange member axially movable with respect to said thread rolling head and secured thereto in such a manner as to open said thread rolling head in response to a rearward movement thereof with respect to said thread rolling head and to close said thread rolling head in response to a forward movement thereof with respect to said thread rolling head.

8. Apparatus adapted for use in a four slide machine as set forth in claim 7, wherein said first stop means is secured to said four slide machine adjacent said first and second sliding members so as to engage said annular flange thereby causing said thread rolling head to open when said thread rolling head is in a first predetermined position.

9. Apparatus adapted for use in a four slide machine as set forth in claim 8 wherein said second stop means is secured to said four slide machine adjacent said first and second sliding members so as to engage said annular flange thereby causing said thread rolling head to close when said thread rolling head is in a second predetermined position.

10. Apparatus adapted for use in a four slide machine as set forth in claim 9 wherein said means securing said first and second stop means to said four slide machine comprise:

a first elongated member extending vertically from and fixedly secured to said four slide machine adjacent one side of said second slidable member, said first elongated member having an elongated slot provided therein adjacent the upper end thereof;

a second elongated member extending vertically from and fixedly secured to said four slide machine adjacent another side of said second slidable member, said second elongated member having an elongated slot provided therein adjacent the upper end thereof;

said first stop means comprising a pair of first cylindrical shaped members each adapted to rotate about a shaft, one of each extending through respective elongated slots of said first and second elongated members and adjustably secured thereto; and said second stop means comprising a pair of second cylindrical shaped members each adapted to rotate about a shaft, one of each of said shafts extending through respective elongated slots of said first and second elongated members and adjustably secured thereto in a spaced apart relationship to said first pair of cylindrical shaped members.

11. Apparatus adapted for use with a four slide machine for enabling said four slide machine to thread at least one end portion of a workpiece while another portion of said workpiece is being formed, said apparatus comprising:

a thread rolling head having an annular flange axially movable with respect to said thread rolling head between a first position in which said thread rolling head is in a closed position and a second position in which said thread rolling head is in an open position, said annular flange adapted to engage spaced apart stop means provided on said four slide machine so as to open and close said thread rolling head when said thread rolling head is in selective predetermined first and second positions with respect to said four slide machine;

driving means connected to said thread rolling head and adapted to continuously rotate said thread rolling head;

a first sliding member, having a pair of spaced apart substantially parallel apertures extending through a lower portion thereof;

mounting means for securing said thread rolling head and said driving means to said sliding member, said mounting means having anti-friction bearing means provided therein to allow said thread rolling head to rotate with respect thereto;

a pair of elongated travel members extending through said apertures, said travel members being adapted to allow said first sliding member to be freely movable therealong;

a second elongated sliding member adapted to be movably secured to said four slide machine; and said four slide machine being operably connected thereto to impart and control reciprocal movement thereof;

a first member securing one end of said travel members to said second sliding member;

a second member securing another end of said travel members to said second sliding member;

said first and second securing members cooperating to limit the travel of said first sliding member along said travel members therebetween; and means biasing said first sliding member into engagement with one of said first and second members.

12. Apparatus adapted for use with a four slide machine as set forth in claim 11 wherein said second sliding member is operably connected to said four slide machine by cam follower means provided on said second sliding member, said cam follower means being adapted to cooperate with cam means provided on said four slide machine to reciprocate said second sliding member with respect to said four slide machine so as to cause said thread rolling head to move into and out of engagement with said workpiece.

13. Apparatus adapted for use with a four slide machine as set forth in claim 11 wherein said driving means comprises a motor, having a drive shaft, means for securing said motor to said first sliding member and a driving shaft extending from said thread rolling head toward said motor; and a resilient coupling connecting said drive and driving shafts.

* * * * *

UNITED STATES PATENT AND TRADEMARK OFFICE

CERTIFICATE OF CORRECTION

PATENT NO. : 4,087,875

DATED : May 9, 1978

INVENTOR(S) : Dean Lacy

It is certified that error appears in the above-identified patent and that said Letters Patent are hereby corrected as shown below:

Abstract, line 1, "adpated" should be --adapted--;

Abstract, line 16, "opration" should be --operation--;

Col. 4, line 50, "spacing" should be --spaced--;

Col. 6, line 38, "inwardly" should be --inward--;

Col. 7, line 64 (Claim 2), after "Apparatus" insert --adapted for use in a four slide machine--;

Col. 9, line 39 (Claim 11), after "said" (second occurrence) insert --first--.

Signed and Sealed this

*Seventh* Day of *November 1978*

[SEAL]

*Attest:*

RUTH C. MASON
*Attesting Officer*

DONALD W. BANNER
*Commissioner of Patents and Trademarks*